US009539721B1

(12) United States Patent
Kao

(10) Patent No.: US 9,539,721 B1
(45) Date of Patent: Jan. 10, 2017

(54) SOCKET HOLDING FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/131,294

(22) Filed: Apr. 18, 2016

(51) Int. Cl.
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC ..... B25B 13/56; B25B 13/06; A47F 5/0846; A47F 7/0028; B25H 3/04; B25H 3/06; B25H 3/003; B25H 3/00
USPC ..... 221/70.6
See application file for complete search history.

(56) References Cited

U.S. PATENT DOCUMENTS 4,621,738 A * 11/1986 DeLucchi ..... B25H 3/003 206/378
4,826,021 A * 5/1989 Burrell ..... B25H 3/003 211/70.6
5,228,570 A * 7/1993 Robinson ..... B25H 3/06 206/375
5,398,823 A * 3/1995 Anders ..... B25H 3/003 206/378
5,467,874 A * 11/1995 Whitaker ..... B25H 3/06 206/378
5,645,177 A * 7/1997 Lin ..... B25H 3/04 206/378
5,725,107 A * 3/1998 Dembicks ..... B25H 3/06 206/378
6,070,745 A * 6/2000 Dembicks ..... B25H 3/06 206/378
6,168,018 B1 * 1/2001 Ramsey ..... B25H 3/06 206/378
6,386,363 B1 * 5/2002 Huang ..... B25H 3/003 206/1.5
6,991,105 B2 * 1/2006 Winnard ..... B25H 3/003 206/378
7,717,278 B2 * 5/2010 Kao ..... B25H 3/04 206/349
7,841,480 B2 * 11/2010 Hsieh ..... B25H 3/06 206/378
8,152,003 B1 * 4/2012 Kao ..... B25H 3/04 211/70.6
8,302,785 B2 * 11/2012 Kao ..... A47F 5/0846 211/70.6
8,517,188 B2 * 8/2013 Kao ..... B25H 3/06 211/70.6

(Continued)

*Primary Examiner* — Patrick Hawn
(74) *Attorney, Agent, or Firm* — patenttm.us

(57) ABSTRACT

A socket holding frame has a track base, a positioning board, and at least one positioning mount. The track base has a bottom panel, a slide rail, and a connecting track. The positioning board is mounted in the connecting track and has multiple first engaging segments formed on a top surface of the positioning board. The at least one positioning mount is slidably and rotatably mounted on the track base, and each one of the at least one positioning mount has a sliding seat and an extending element. The sliding seat is slidably and rotatably mounted in the slide rail and has multiple second engaging segments. The multiple second engaging segments engage with the multiple first engaging segments of the positioning board. The extending element is formed on the sliding seat and extends out of the slide rail.

5 Claims, 9 Drawing Sheets

(56) References Cited

U.S. PATENT DOCUMENTS 8,733,561 B2 * 5/2014 Kao ..... B25H 3/04 206/378
9,126,329 B2 * 9/2015 Kao ..... B25H 3/04
9,186,790 B1 * 11/2015 Kao ..... B25H 3/06
2001/0001197 A1 * 5/2001 Ramsey ..... B25H 3/06 206/378
2002/0144962 A1 * 10/2002 Dettorre ..... A47F 5/0838 211/85.7
2003/0019775 A1 * 1/2003 Ernst ..... B25H 3/003 206/378
2005/0247653 A1 * 11/2005 Brooks ..... B25H 3/04 211/94.01
2006/0118499 A1 * 6/2006 Kao ..... A47F 5/083 211/70.6
2006/0207951 A1 * 9/2006 Wang ..... A47F 7/024 211/70.6
2007/0017886 A1 * 1/2007 Kao ..... A47F 5/0807 211/94.01
2009/0090644 A1 * 4/2009 Kao ..... B25H 3/04 206/373
2009/0134288 A1 * 5/2009 Kao ..... B25H 3/04 248/214
2010/0065520 A1 * 3/2010 Hsieh ..... B25H 3/06 211/70.6
2011/0089126 A1 * 4/2011 Hsieh ..... B25H 3/003 211/70.6
2012/0138553 A1 * 6/2012 Kao ..... B25H 3/06 211/70.6
2012/0152871 A1 * 6/2012 Kao ..... A47F 5/0846 211/70.6
2013/0062480 A1 * 3/2013 Kao ..... B25H 3/04 248/201
2013/0153521 A1 * 6/2013 Kao ..... B25H 3/04 211/70.6
2015/0034518 A1 * 2/2015 Kao ..... B65D 1/36 206/372
2015/0034572 A1 * 2/2015 Kao ..... B25H 3/04 211/13.1
2015/0122750 A1 * 5/2015 Kao ..... B25H 3/04 211/13.1
2015/0336262 A1 * 11/2015 Kao ..... B25H 3/06 206/378
2016/0096264 A1 * 4/2016 Kao ..... B25H 3/06 206/378

* cited by examiner

SOCKET HOLDING FRAME

BACKGROUND OF THE INVENTION

1. Field of the Invention

The present invention relates to a socket holding frame, and more particularly to a socket holding frame that may provide a positioning effect to sockets that are mounted on the socket holding frame.

2. Description of Related Art

A conventional socket holding frame has a track base and multiple positioning mounts slidably mounted on the track base. The positioning mounts are used to hold sockets on the track base to allow a user to look for the marks of sizes or model numbers on outer peripheries of the sockets by rotating the sockets. To move or rotate the sockets easily and quickly, the track base is not set up with any fixing structure for fixing the positioning mounts with the track base. Hence, the positioning mounts may be moved or rotated by impact or hit by an unexpected force, such that the user has to frequently and repeatedly look for the marks of sizes or model numbers of the sockets, which is very inconvenient in use.

To overcome the shortcomings of the conventional socket holding frame, the present invention provides a socket holding frame to mitigate or obviate the aforementioned problems.

SUMMARY OF THE INVENTION

The present invention relates to a socket holding frame, and more particularly to a socket holding frame that may provide a positioning effect to sockets that are mounted on the socket holding frame.

The socket holding frame has a track base, a positioning board, and at least one positioning mount. The track base has a bottom panel, a slide rail, and a connecting track. The positioning board is mounted in the connecting track and has multiple first engaging segments formed on a top surface of the positioning board. The at least one positioning mount is slidably and rotatably mounted on the track base, and each one of the at least one positioning mount has a sliding seat and an extending element. The sliding seat is slidably and rotatably in the slide rail and has multiple second engaging segments. The multiple second engaging segments engage with the multiple first engaging segments of the positioning board. The extending element is formed on the sliding seat and extends out of the slide rail.

Other objects, advantages, and novel features of the invention will become more apparent from the following detailed description when taken in conjunction with the accompanying drawings.

DETAILED DESCRIPTION OF PREFERRED EMBODIMENT

Figure 1:
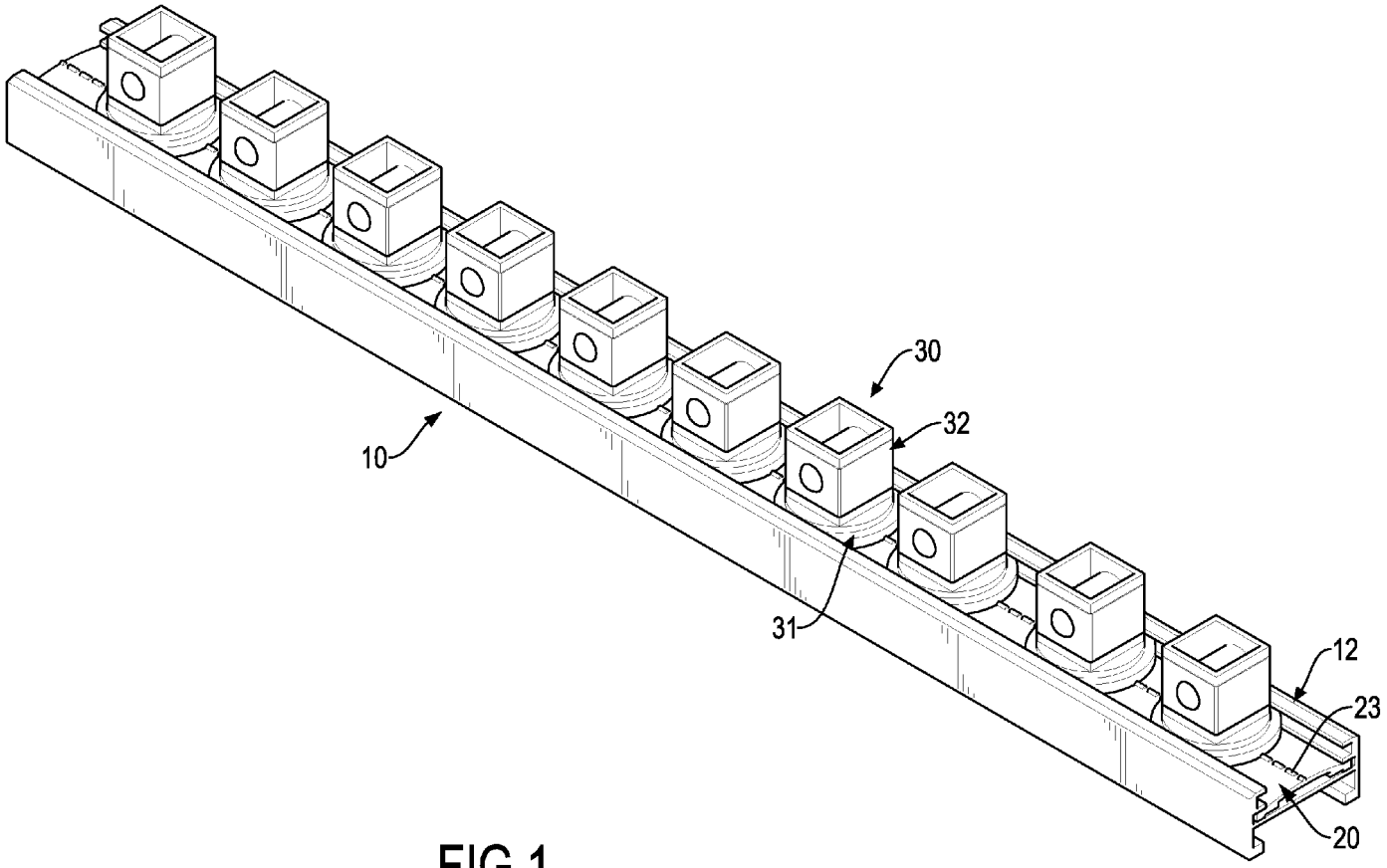
FIG. 1 is a perspective view of a first embodiment of a socket holding frame in accordance with the present invention.
Figure 2:
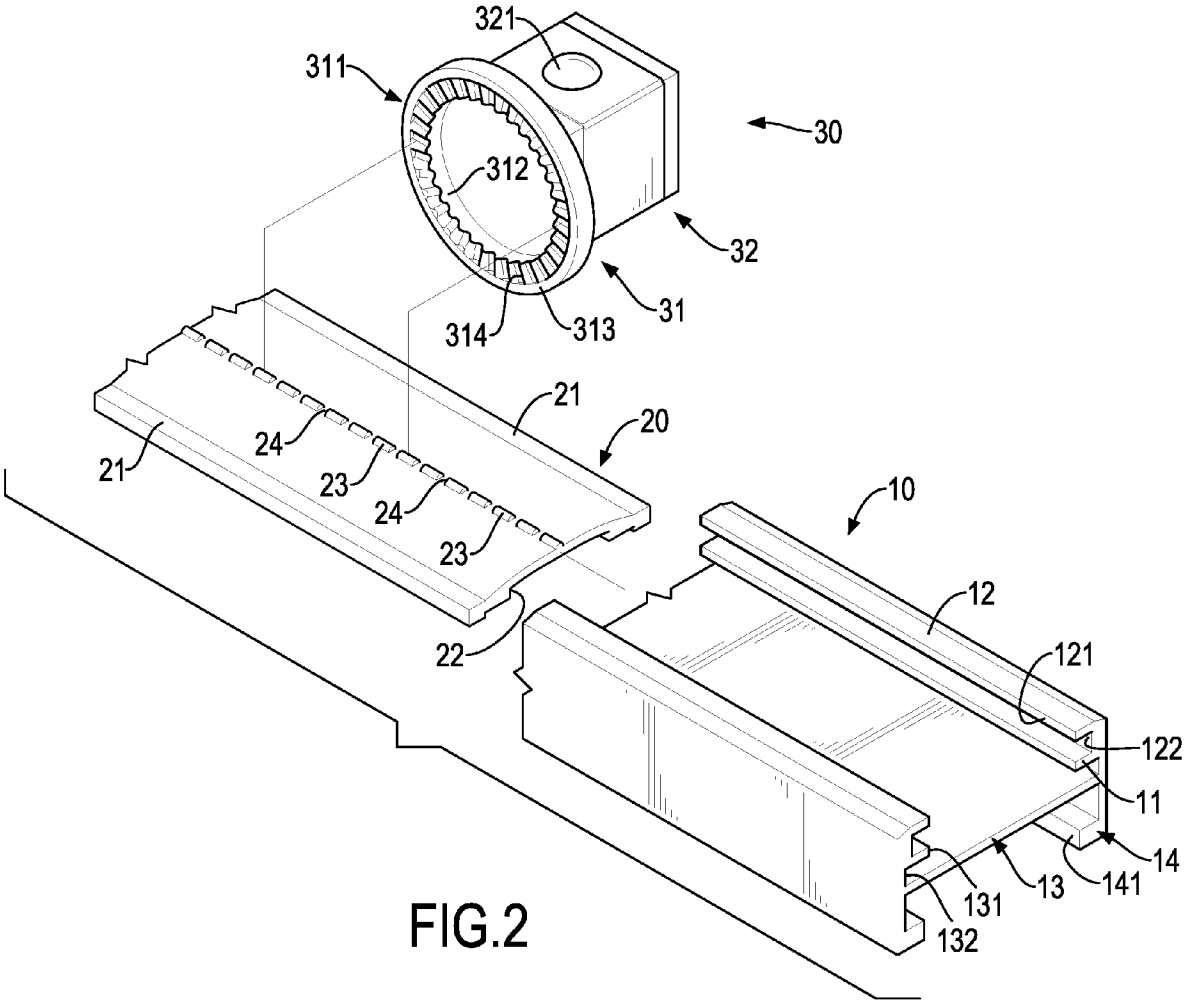
FIG. 2 is an enlarged and exploded perspective view of the socket holding frame in FIG. 1.
Figure 3:
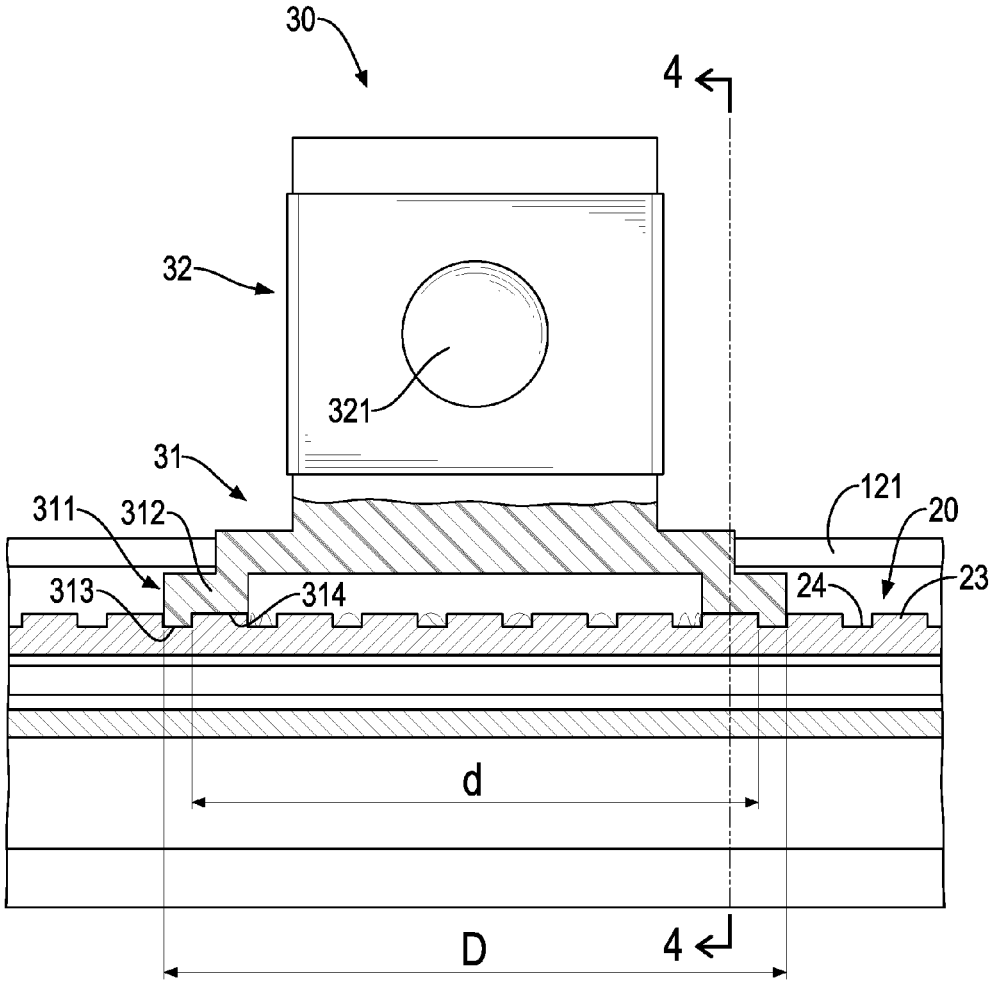
FIG. 3 is an enlarged side view in partial section of the socket holding frame in FIG. 1.
Figure 4:
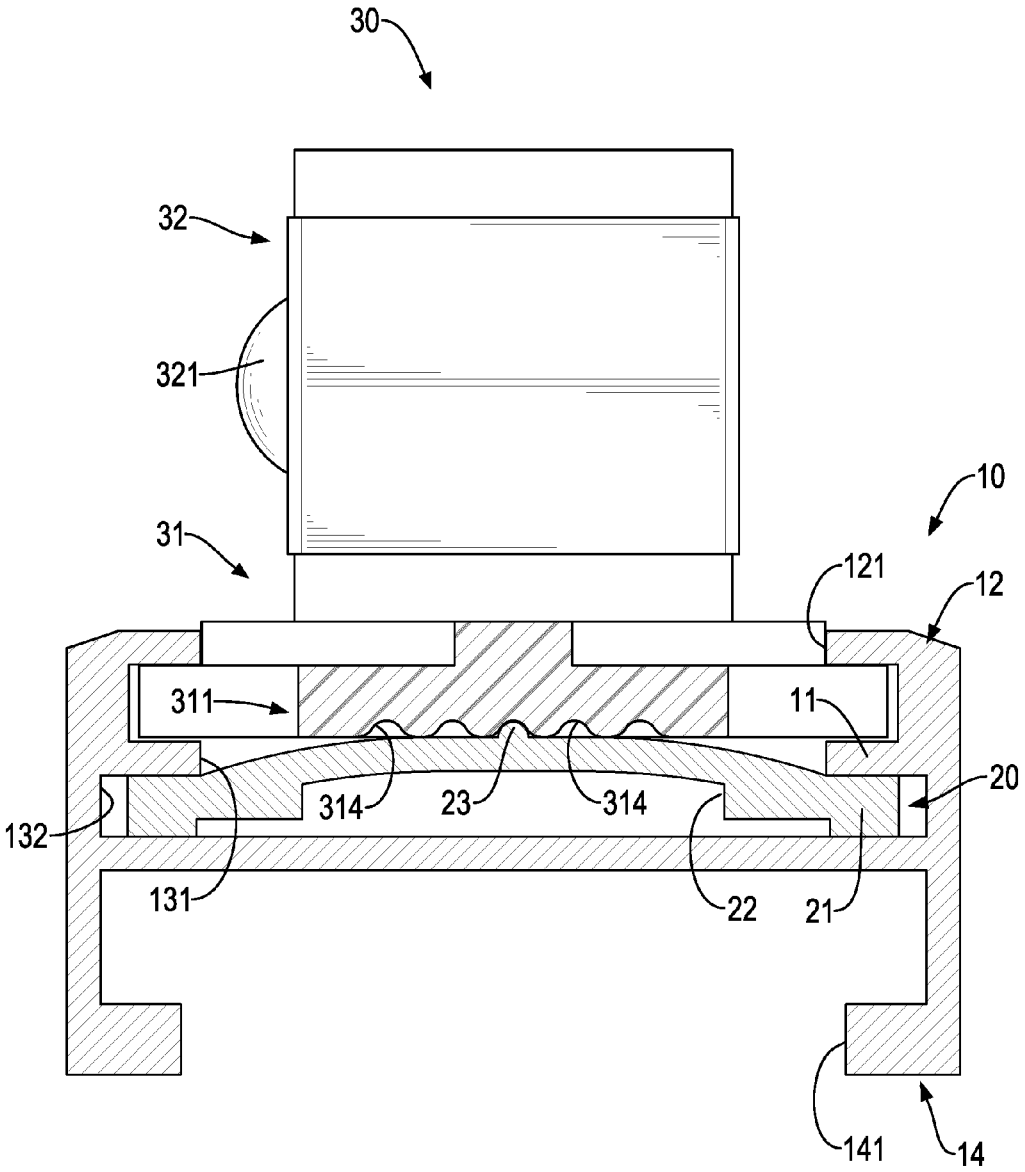
FIG. 4 is an enlarged side view in partial section of the socket holding frame along line 4-4 in FIG. 3.

With reference to FIGS. 1 to 4, a first embodiment of a socket holding frame in accordance with the present invention comprises a track base 10, a positioning board 20, and at least one positioning mount 30.

The track base 10 is made of aluminum, is an elongated seat and has a bottom panel 11, a slide rail 12, a connecting track 13, and a closed track 14. The bottom panel 11 is elongated and has a top surface, a bottom surface, a front end, and a rear end. The slide rail 12 is formed on and protrudes from the top surface of the bottom panel 11 between the front end and the rear end of the bottom panel 11 and has a top side, a top opening 121, and a sliding recess 122. The top opening 121 is formed through the top side of the slide rail 12. The sliding recess 122 is formed in the slide rail 12 between the top side of the slide rail 12 and the top surface of the bottom panel 11 and communicates with the top opening 121.

The connecting track 13 is formed on and protrudes from the bottom surface of the bottom panel 11, and has a top side, a bottom surface, a communicating opening 131, and a connecting recess 132. The top side of the connecting track 13 is formed on and protrudes from the bottom surface of the bottom panel 11. The communicating opening 131 is formed through the top side of the connecting track 13 and the bottom surface of the bottom panel 11, and communicates with the sliding recess 122 of the slide rail 12. The connecting recess 132 is formed between the bottom panel 11 and the connecting track 13 and communicates with the communicating opening 131.

The closed track 14 is formed on and protrudes from the bottom surface of the connecting track 13 and has a bottom side and a bottom opening 141. The bottom opening 141 is formed through the bottom side of the closed track 14. In addition, the closed track 14 and the slide rail 12 are formed on the bottom panel 11 as a single piece.

The positioning board 20 is elastic, is mounted in the connecting track 13 of the track base 10, and has two long opposite sides, two free ends, a middle, a top surface, a bottom surface, two rail bars 21, a through recess 22, multiple first engaging segments 23, and multiple engaging spaces 24. The positioning board 20 is bent upwardly from the long opposite sides of the positioning board 20 to the middle of the positioning board 20. Then, the top surface of the positioning board 20 at the middle of the positioning board 20 extends at the communicating opening 131 of the connecting track 13. In addition, the positioning board 20 may be formed with the track base 10 as a single piece.

The two rail bars 21 are formed on and protrude outwardly from the bottom surface of the positioning board 20 respectively at the two long opposite sides of the positioning board 20 and are mounted in the connecting recess 132 of the connecting track 13. The through recess 22 is formed in the bottom surface of the positioning board 20 at the middle of the positioning board 20 between the free ends of the positioning board 20, is parallel with the long opposite sides of the positioning board 20, and communicates with the connecting recess 132 of the connecting track 13. Then, a space is formed between the connecting track 13 and the middle of the positioning board 20, and the space may allow the middle of the positioning board 20 to deform relative to the track base 10.

The multiple first engaging segments 23 are formed on and protrude from the top surface of the positioning board 20 at spaced intervals between the two free ends of the positioning board 20. The first engaging segments 23 are aligned in a straight line and are formed at the middle of the top surface of the positioning board 20 at spaced intervals. Each one of the multiple engaging spaces 24 is formed between two adjacent first engaging segments 23.

The at least one positioning mount 30 is slidably and rotatably mounted on the track base 10, and each one of the at least one positioning mount 30 has a sliding seat 31 and an extending element 32. The sliding seat 31 is round and elastic, is slidably and rotatably mounted in the sliding recess 122 of the slide rail 12, and engages with two of the multiple first engaging segments 23 of the positioning board 20. The sliding seat 31 has a bottom side, a top side, and an engaging flange 311. The bottom side of the sliding seat 31 faces the communicating opening 131 of the connecting track 13 and engages with the two of the multiple first engaging segments 23 of the positioning board 20. The top side of the sliding seat 31 faces the top opening 121 of the slide rail 12.

Figure 5:
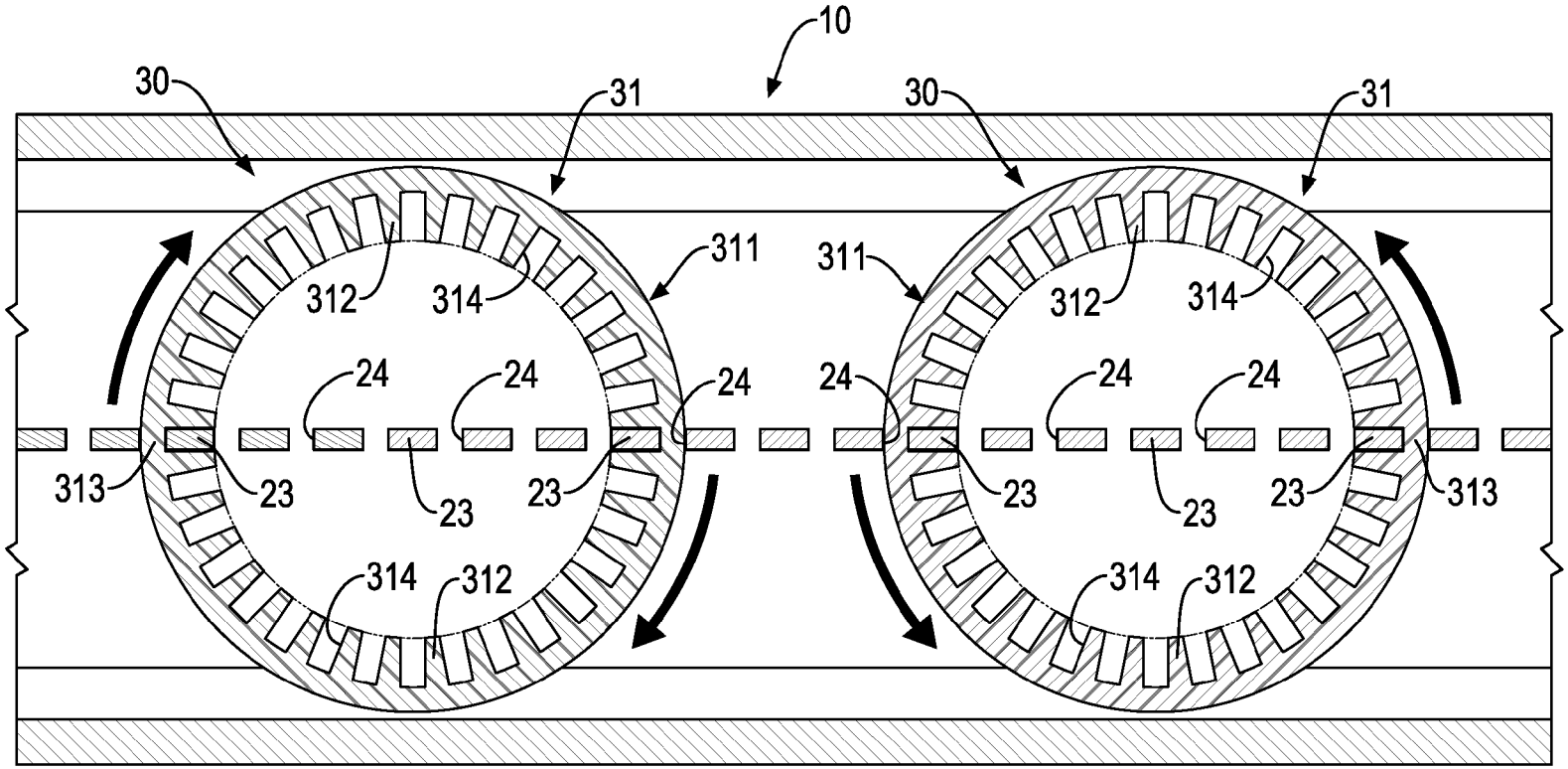
FIG. 5 is an operational enlarged cross sectional top view of the socket holding frame in FIG. 1.

With further reference to FIG. 5, the engaging flange 311 is formed on and protrudes downwardly from the bottom side of the sliding seat 31 and has a bottom surface, an inner ring 312, an outer ring 313, and multiple second engaging segments 314. The inner ring 312 is formed on the bottom surface of the engaging flange 311, and has an outer diameter d and a bottom surface. The outer ring 313 is formed on the bottom surface of the engaging flange 311 and around the inner ring 312, engages with two of the multiple engaging spaces 24, and has an outer diameter D. The outer diameter D of the outer ring 313 is larger than the outer diameter d of the inner ring 312 to enable the outer ring 313 to mount around the inner ring 312. The multiple second engaging segments 314 are continuously formed in the bottom surface of the inner ring 312 of the engaging flange 311 of the sliding seat 31 at spaced intervals, and are along the inner ring 312 of the engaging flange 311. Each one of the multiple second engaging segments 314 engages with the two of the multiple first engaging segments 23. Additionally, each one of the multiple second engaging segments 314 is a groove.

The extending element 32 is formed on and protrudes upwardly from the top side of the sliding seat 31 and extends out of the slide rail 12 via the top opening 121. Furthermore, the extending element 32 of each one of the at least one positioning mount 30 is an insertion button. The extending element 32 is hollow, is rectangular, and has a side surface and a protruding ball 321. The protruding ball 321 is mounted in and extends outwardly from the side surface of the insertion button.

Figure 6:
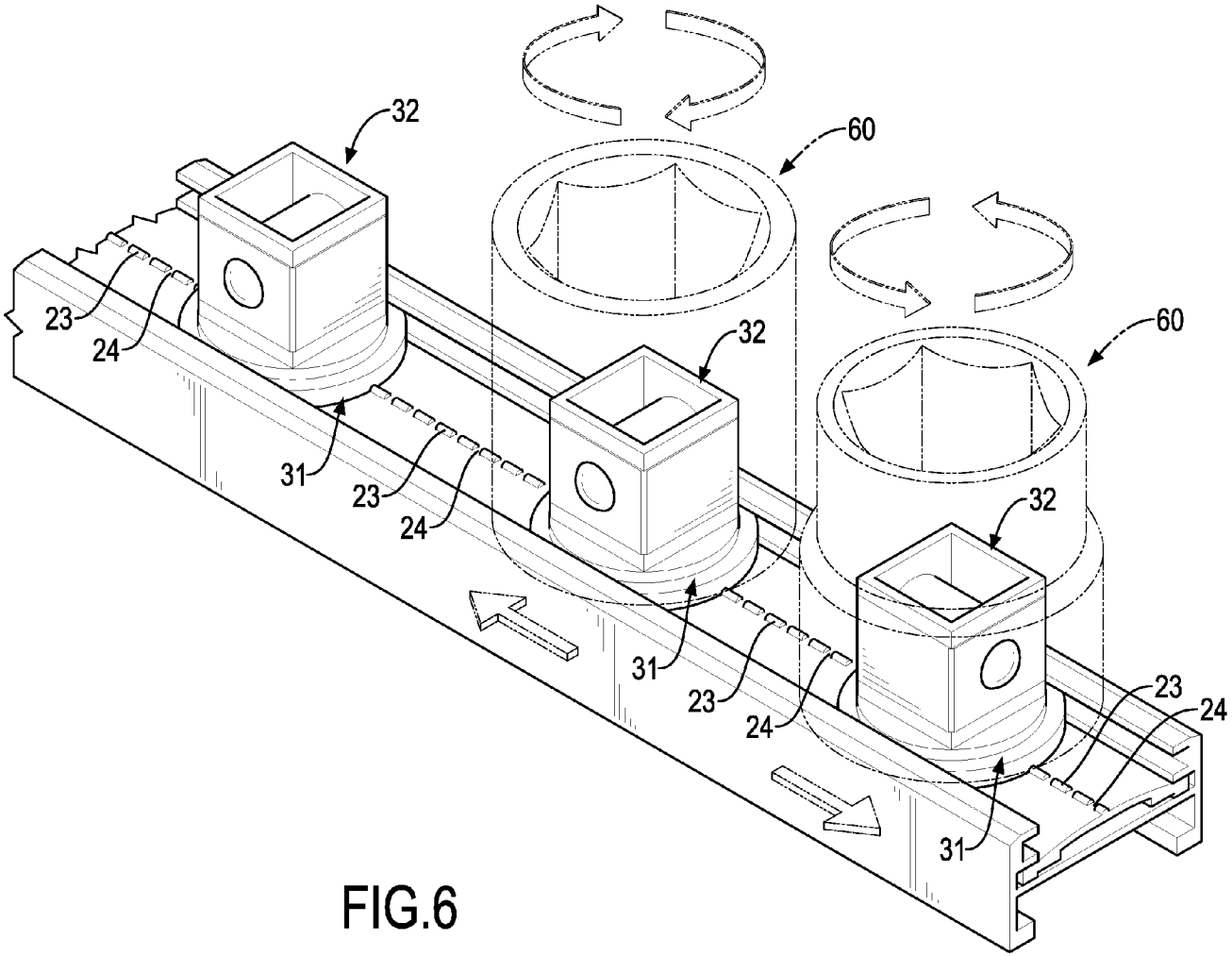
FIG. 6 is an enlarged operational perspective view of the socket holding frame in FIG. 1, shown with two sockets mounted on the socket holding frame.

With reference to FIGS. 5 and 6, when the first embodiment of the socket holding frame in the present invention is in use, the socket holding frame has multiple positioning mounts 30 mounted on the track base 10, and multiple sockets 60 are respectively and detachably mounted around the extending elements 32 of the positioning mounts 30. When each socket 60 is mounted around the extending element 32 of a corresponding positioning mount 30, the protruding ball 321 of the extending element 32 engages with a recess in an inner wall of the socket 60. Consequently, the sockets 60 are positioned on the extending elements 32 of the positioning mounts 30. When numbers or signs on the sockets 60 are not aligned at a same direction to face a user, the user may rotate the sockets 60 in a clockwise or counterclockwise direction relative to the track base 10 as shown in FIG. 6 to enable the numbers or signs of the sockets 60 to face the user. During the above-mentioned rotating process, the sliding seats 31 of the positioning mounts 30 may be rotated with the sockets 60 relative to the positioning board 20 by the engagement between the extending elements 32 of the positioning mounts 30 and the sockets 60.

When the sockets 60 are rotated to enable the number or sign on the sockets 60 to face the user, the engagement between the multiple second engaging segments 314 and the multiple first engaging segments 23 and the engagement between the outer ring 313 and the multiple engaging spaces 24 enable the sliding seats 31 to engage with the positioning board 20. That is, the engagement between the multiple second engaging segments 314 and the multiple first engaging segments 23 and the engagement between the outer ring 313 and the multiple engaging spaces 24 provide a positioning effect to the positioning mounts 30 on the positioning board 20 relative to the track base 10. Therefore, the positioning mounts 30 may be positioned securely on the positioning board 20, and the user may recognize the sizes of the sockets 60 by the numbers or signs easily and conveniently.

Figure 7:
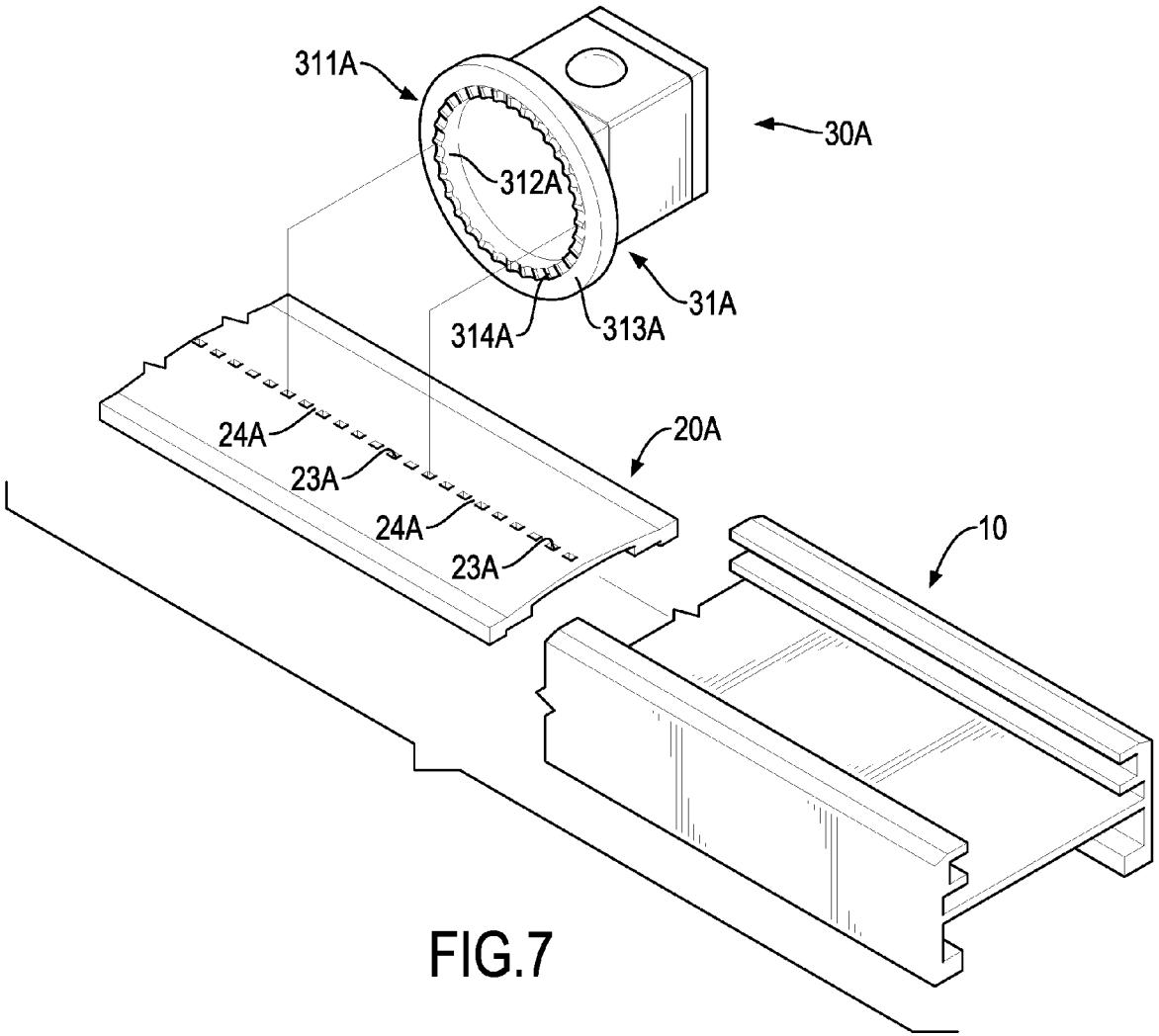
FIG. 7 is an enlarged and exploded perspective view of a second embodiment of a socket holding frame in accordance with the present invention.
Figure 8:
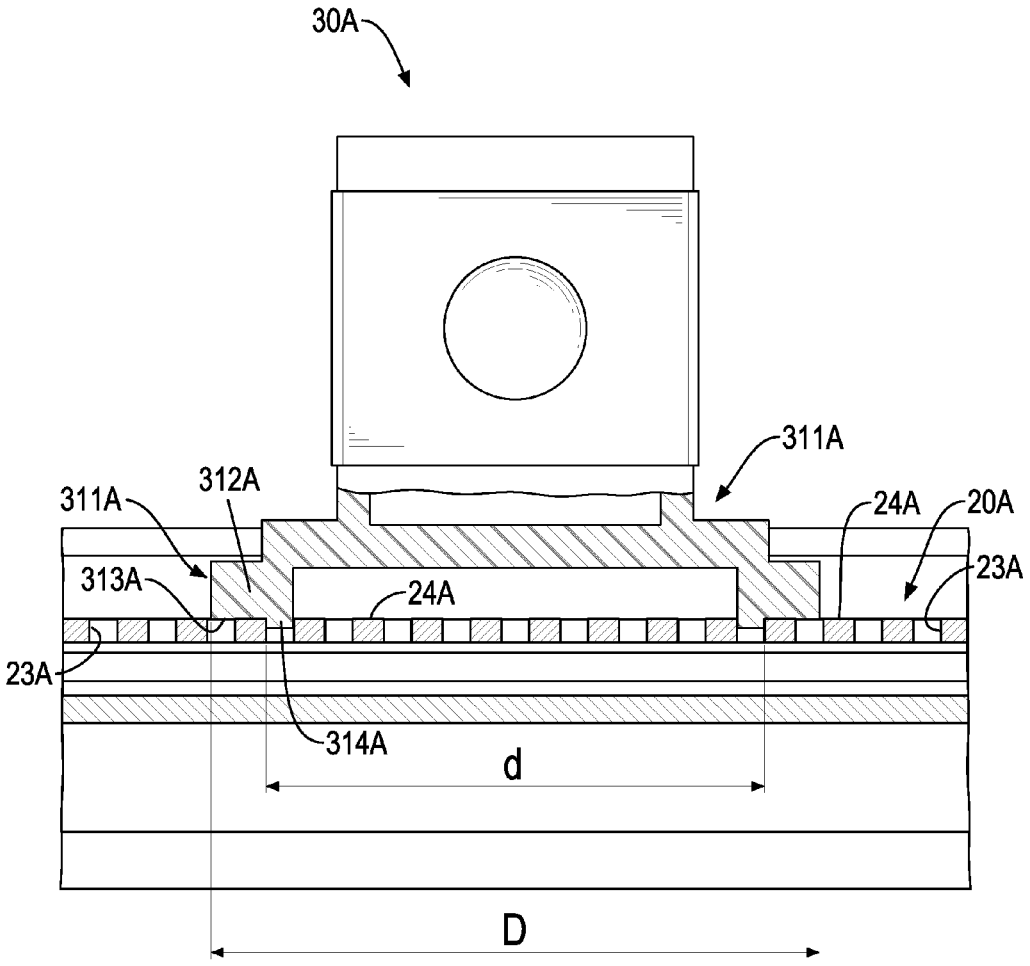
FIG. 8 is an enlarged side view in partial section of the socket holding frame in FIG. 7.
Figure 9:
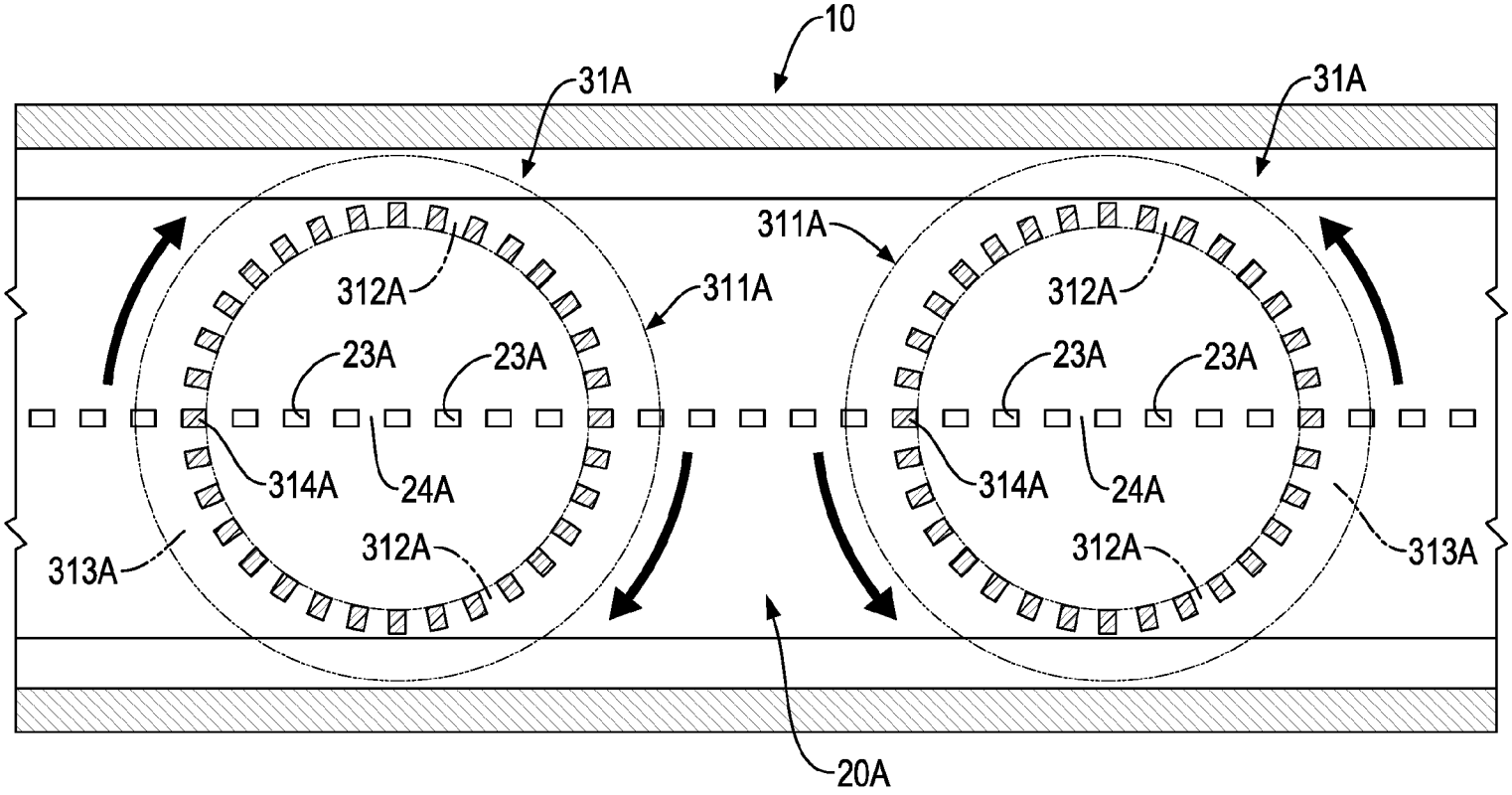
FIG. 9 is an operational enlarged cross sectional top view of the socket holding frame in FIG. 7.

With reference to FIGS. 7 to 9, a second embodiment of a socket holding frame in accordance with the present invention is substantially the same as the first embodiment except for the following features. The multiple first engaging segments 23A are formed in the top surface of the positioning board 20A at spaced intervals between the two free ends of the positioning board 20A. Each one of the multiple first engaging segments 23A is a groove. The multiple second engaging segments 314A are continuously formed on and protrude downwardly from the inner ring 312A of the engaging flange 311A of the sliding seat 31A at spaced intervals, and are along the inner ring 312A of the sliding seat 31A. Each one of the multiple second engaging segments 314A engages with two of the multiple first engaging segments 23A. The outer ring 313A of the engaging flange 311A abuts two of the multiple engaging spaces 24A. The operation procedure of the second embodiment is the same as the first embodiment, and the detailed description thereof will be omitted.

According to the above-mentioned operations of the two embodiments in the present invention, each one of the multiple second engaging segments 314, 314A of the engaging flange 311, 311A of the sliding seat 31, 31A engages with two of the multiple first engaging segments 23, 23A of the positioning board 20, 20A. The outer ring 313, 313A of the engaging flange 311, 311A of the sliding seat 31, 31A engages or abuts two of the multiple engaging spaces 24, 24A. Therefore, the at least one positioning mount 30, 30A is securely mounted on the track base 10.

What is claimed is:

1. A socket holding frame comprising:

a track base being an elongated seat and having a bottom panel being elongated and having a top surface;

a bottom surface;

a front end; and a rear end; and a slide rail formed on and protruding from the top surface of the bottom panel between the front end and the rear end of the bottom panel and having a top side;

a top opening formed through the top side of the slide rail; and a sliding recess formed in the slide rail between the top side of the slide rail and the top surface of the bottom panel and communicating with the top opening;

a positioning board connected to the track base and having two long opposite sides;

two free ends;

a middle, and the positioning board bent upwardly from the long opposite sides of the positioning board to the middle of the positioning board;

a top surface, and the top surface of the positioning board extending toward the slide rail at the middle of the positioning board;

a bottom surface; and multiple first engaging segments formed on the top surface of the positioning board at spaced intervals between the two free ends of the positioning board, and aligned in a straight line and formed at the middle of the top surface of the positioning board;

at least one positioning mount slidably and rotatably mounted on the track base, and each one of the at least one positioning mount having a sliding seat slidably and rotatably mounted in the sliding recess of the slide rail and engaging with two of the multiple first engaging segments of the positioning board and having a bottom side;

a top side facing the top opening of the slide rail;

an engaging flange formed on and protruding downwardly from the bottom side of the sliding seat, and having a bottom surface;

an inner ring formed on the bottom surface of the engaging flange and having a bottom surface; and multiple second engaging segments formed on the bottom surface of the inner ring of the engaging flange of the sliding seat at spaced intervals, being along the inner ring of the sliding seat, and each one of the multiple second engaging segments engaging with two of the multiple first engaging segments; and an extending element formed on and protruding upwardly from the top side of the sliding seat and extending out of the slide rail via the top opening.

2. The socket holding frame as claimed in claim 1, wherein the track base has a connecting track formed on and protruding from the bottom surface of the bottom panel, and having a top side formed on and protruding from the bottom surface of the bottom panel;

a communicating opening formed through the top side of the connecting track and the bottom surface of the bottom panel, and communicating with the sliding recess of the slide rail; and a connecting recess formed between the bottom panel and the connecting track and communicating with the communicating opening;

the positioning board is mounted in the connecting track of the track base and has two rail bars formed on and protruding outwardly from the bottom surface of the positioning board respectively at the two long opposite sides of the positioning board and mounted in the connecting recess of the connecting track; and a through recess formed in the bottom surface of the positioning board at the middle of the positioning board between the two free ends of the positioning board, being parallel with the long opposite sides of the positioning board, and communicating with the connecting recess of the connecting track.

3. The socket holding frame as claimed in claim 2, wherein one of the positioning board and the sliding seat of the at least one positioning mount is elastic.

4. The socket holding frame as claimed in claim 3, wherein the multiple first engaging segments are formed on and protrude from the top surface of the positioning board;

the positioning board has multiple engaging spaces, and each one of the multiple engaging spaces is formed between two adjacent first engaging segments; and the engaging flange has an outer ring formed on the bottom surface of the engaging flange and around the inner ring, and engaging with two of the multiple engaging spaces; and each one of the multiple second engaging segments is a groove.

5. The socket holding frame as claimed in claim 3, wherein the multiple first engaging segments are formed in the top surface of the positioning board at spaced intervals between the two free ends of the positioning board, and each one of the multiple first engaging segments is a groove; and the positioning board has multiple engaging spaces, each one of the multiple engaging spaces is formed between two adjacent first engaging segments;

the multiple second engaging segments are continuously formed on and protrude downwardly from the inner ring of the engaging flange of the sliding seat at spaced intervals; and the engaging flange has an outer ring formed on the bottom surface of the engaging flange and around the inner ring, and abutting two of the multiple engaging spaces.

* * * * *